US005865134A

United States Patent [19]

Okuyama et al.

[11] Patent Number: 5,865,134

[45] Date of Patent: Feb. 2, 1999

[54] SEWING DATA CONVERTING DEVICE FOR SEWING MACHINE

[75] Inventors: Tsuneo Okuyama, Inabe-gun; Akihiro Wakayama; Takashi Hirata, both of Nagoya, all of Japan

[73] Assignee: Brother Kogyo Kabushiki Kaisha, Nagoya, Japan

[21] Appl. No.: 49,293

[22] Filed: Mar. 27, 1998

[30] Foreign Application Priority Data

Mar. 28, 1997 [JP] Japan ..... 9-77532

[51] Int. Cl.[6] ..... D05C 5/04; D05B 21/00; G06F 19/00

[52] U.S. Cl. ..... 112/102.5; 112/300; 112/475.19; 364/470.09

[58] Field of Search ..... 112/102.5, 456, 112/457, 300, 470.06, 475.19; 364/470.09, 470.08

[56] References Cited

U.S. PATENT DOCUMENTS 5,270,939 12/1993 Goldberg et al. ..... 364/470.09
5,357,442 10/1994 Sekine ..... 364/470.08
5,392,724 2/1995 Kurono et al. ..... 112/102.5

FOREIGN PATENT DOCUMENTS

A-6-309112 11/1994 Japan .

*Primary Examiner*—Peter Nerbun
*Attorney, Agent, or Firm*—Oliff & Berridge, PLC

[57] ABSTRACT

A sewing data converting device includes a storage means for storing sewing data used in one embroidery machine for executing a sewing operation including an embroidering operation. The sewing data is converted into another sewing data used in another embroidery machine having a data format differing from one of the one embroidery machine. Display data for the converted sewing data is originated so that the display data corresponds to a display format of the another embroidery machine.

16 Claims, 15 Drawing Sheets

| |
|---|
| FIRST STITCH DATA |
| SECOND STITCH DATA |
| COLOR CHANGE DATA |
| THIRD STITCH DATA |
| ⋮ |
| NINTH STITCH DATA |
| STOP DATA |
| TENTH STITCH DATA |
| ⋮ |
| FINAL DATA |

FIG. 9A

| |
|---|
| FIRST STITCH DATA |
| SECOND STITCH DATA |
| COLOR CHANGE DATA |
| THREAD CUTTING DATA |
| THIRD STITCH DATA |
| ⋮ |
| NINTH STITCH DATA |
| STOP DATA |
| THREAD CUTTING DATA |
| TENTH STITCH DATA |
| ⋮ |
| FINAL DATA |

FIG. 9B

| ADDRESS VALUE | MEMORY CARD |
|---|---|
| 1000 | DISPLAY DATA OF PATTERN 1 |
| 1020 | DISPLAY DATA OF PATTERN 2 |
| 1040 | DISPLAY DATA OF PATTERN 3 |
| 1060 | DISPLAY DATA OF PATTERN 4 |
| | ⋮ |
| 2000 | SEWING DATA OF PATTERN 1 |
| 2100 | SEWING DATA OF PATTERN 2 |
| 2200 | SEWING DATA OF PATTERN 3 |
| 2200 | SEWING DATA OF PATTERN 4 |
| | ⋮ |

14

FIG. 15A

| ADDRESS VALUE | MEMORY CARD |
|---|---|
| 1000 | DISPLAY DATA OF PATTERN 1 |
| 1020 | END DATA OF DISPLAY DATA OF PATTERN 1 |
| 1022 | SEWING DATA OF PATTERN 1 |
| 1122 | END DATA OF SEWING DATA OF PATTERN 1 |
| 1124 | DISPLAY DATA OF PATTERN 2 |
| 1144 | END DATA OF DISPLAY DATA OF PATTERN 2 |
| 1146 | SEWING DATA OF PATTERN 2 |
| 1246 | END DATA OF SEWING DATA OF PATTERN 2 |
| 1248 | DISPLAY DATA OF PATTERN 3 |
| 1268 | END DATA OF DISPLAY DATA OF PATTERN 3 |
| 1270 | SEWING DATA OF PATTERN 3 |
| 1370 | END DATA OF SEWING DATA OF PATTERN 3 |
| 1372 | DISPLAY DATA OF PATTERN 4 |
| 1392 | END DATA OF DISPLAY DATA OF PATTERN 4 |
| 1394 | SEWING DATA OF PATTERN 4 |
| 1494 | END DATA OF SEWING DATA OF PATTERN 4 |
| | ⋮ |

18

FIG. 15B

14

| ADDRESS | MEMORY CARD | INDICATED ADDRESS |
|---|---|---|
| 500 | FIRST ADDRESS DATA OF DISPLAY DATA OF PATTERN 1 | 1000 |
| 502 | FIRST ADDRESS DATA OF DISPLAY DATA OF PATTERN 2 | 1020 |
| 504 | FIRST ADDRESS DATA OF DISPLAY DATA OF PATTERN 3 | 1050 |
| | ⋮ | |
| 600 | FIRST ADDRESS DATA OF SEWING DATA OF PATTERN 1 | 2000 |
| 602 | FIRST ADDRESS DATA OF SEWING DATA OF PATTERN 2 | 2100 |
| 604 | FIRST ADDRESS DATA OF SEWING DATA OF PATTERN 3 | 2300 |
| | ⋮ | |
| 1000 | DISPLAY DATA OF PATTERN 1 | |
| 1020 | DISPLAY DATA OF PATTERN 2 | |
| 1050 | DISPLAY DATA OF PATTERN 3 | |
| | ⋮ | |
| 2000 | SEWING DATA OF PATTERN 1 | |
| 2100 | SEWING DATA OF PATTERN 2 | |
| 2300 | SEWING DATA OF PATTERN 3 | |
| | ⋮ | |

FIG. 16A

18

| ADDRESS | MEMORY CARD | INDICATED ADDRESS |
|---|---|---|
| 300 | FIRST ADDRESS DATA OF SEWING DATA OF PATTERN 1 | 1020 |
| 302 | FIRST ADDRESS DATA OF SEWING DATA OF PATTERN 2 | 1150 |
| 304 | FIRST ADDRESS DATA OF SEWING DATA OF PATTERN 3 | 1400 |
| | ⋮ | |
| 400 | FIRST ADDRESS DATA OF DISPLAY DATA OF PATTERN 1 | 1000 |
| 402 | FIRST ADDRESS DATA OF DISPLAY DATA OF PATTERN 2 | 1120 |
| 404 | FIRST ADDRESS DATA OF DISPLAY DATA OF PATTERN 3 | 1350 |
| | ⋮ | |
| 1000 | DISPLAY DATA OF PATTERN 1 | |
| 1020 | SEWING DATA OF PATTERN 1 | |
| 1120 | DISPLAY DATA OF PATTERN 2 | |
| 1150 | SEWING DATA OF PATTERN 2 | |
| 1350 | DISPLAY DATA OF PATTERN 3 | |
| 1400 | SEWING DATA OF PATTERN 3 | |
| | ⋮ | |

FIG. 16B

SEWING DATA CONVERTING DEVICE FOR SEWING MACHINE

BACKGROUND OF THE INVENTION

1. Field of the Invention

This invention relates to a sewing data converting device with a function of converting sewing data used in one sewing means such as an embroidery machine into sewing data used in another sewing means having a data format differing from one of said one sewing means.

2. Description of the Related Art

There has recently been provided a household embroidery machine which forms a desired embroidery pattern on a workpiece cloth based on sewing data indicative of an amount of feed of an embroidery frame (the workpiece cloth) for every stitch, namely, an amount of movement of a sewing needle etc. The sewing data corresponding to a number of embroidery patterns are stored in a memory built in a main body of the embroidery machine or in an external memory card (IC card). The sewing data are supplied into a control device provided in the main body of the embroidery machine. The internal memory or the external memory card stores display data used to display an approximate form of the embroidery pattern or a display on a display of the embroidery machine as well as the sewing data.

One type of embroidery machine by one manufacturer sometimes differs in a hardware arrangement or a data format from embroidery machines by other manufacturers or from other types of embroidery machines by the same manufacturer. Accordingly, the sewing data used in one type of embroidery machine by one manufacturer cannot be used in embroidery machines of the other makers or in other types of embroidery machines by the same manufacturer. To cope with this problem, the prior art has proposed data converting devices for converting the sewing data so that the sewing data is applied to other embroidery machines having data formats differing from one the original sewing data matches. For example, Japanese patent publication No. 6-309112-A (1994) discloses one of such data converting devices.

However, the disclosed data converting device simply converts the sewing data for the movement of the sewing needle and accompanying display data into the sewing data of another data format. As a result, the converted sewing data cannot sufficiently operate the embroidery machine because of differences in the hardware arrangement, performance, etc. More specifically, when a display device of one embroidery machine using one sewing data differs in the shape, size, and the number of picture elements (resolution) from a display device of another embroidery machine using sewing data converted from said one sewing data, a proper displaying operation cannot sometimes be executed on the basis of the converted sewing data by the display device of said another embroidery machine. The difference between a monochrome display and a color display also reduces the displaying performance of the display device of the embroidery machine using the converted sewing data. Furthermore, a proper sewing operation cannot be executed on the basis of the converted sewing data depending upon whether the embroidery machine is provided with an automatic thread cutting mechanism or a needle rocking mechanism. Additionally, the sewing operation cannot properly be executed due to the difference in precision of motor stop position.

SUMMARY OF THE INVENTION

Therefore, an object of the present invention is to provide an improved sewing data converting device which can add a new value to the converted sewing data to thereby improve the usability of the data when the sewing data used in one sewing means is converted to the sewing data used in another sewing means having a data format differing from that of said one sewing means.

The present invention provides a sewing data converting device comprising storage means for storing sewing data used in one sewing means for executing a sewing operation including an embroidering operation, converting means for converting the sewing data into another sewing data used in another sewing means having a data format differing from one of said one sewing means, and display data originating means for originating display data for the converted sewing data so that the display data corresponds to a display format of said another sewing means.

According to the above-described device, the display data related to the converted sewing data is originated by the display data originating means when the sewing data in said one sewing means is converted to the sewing data for said another sewing means. In this case, the display data is adapted for the display format of said another sewing means and originated from the sewing data. Consequently, the display data can be approximated more to the form of the embroidery pattern. Thus, even if the display format of said another sewing means differs from that of said one sewing means, a proper displaying operation can be executed on the basis of the originated display data.

The sewing data converting device preferably further comprises data adding means for adding to the converted sewing data operating data for an operation of a needle thread peculiar to said another sewing means. The operating data for the operation of the needle thread based on the conditions peculiar to said another sewing means is added when the sewing data of said one sewing means is converted to the sewing data for said another sewing means. The operation of the needle thread is executed on the basis of the converted sewing data in said other sewing means even if the operation is not executed in said one sewing means. Consequently, the sewing means can be operated more properly. The operation of the needle thread preferably includes a needle rocking operation or a thread cutting operation. Furthermore, the sewing data converting device is preferably provided with both the data adding means and the display data originating means.

The sewing data converting device preferably further comprises data sequencing means for changing a sequence of a plurality of data including the converted sewing data and data related to the converted sewing data according to a data reading sequence in said another sewing means, instead of the display data originating means and the data adding means. The sequence of the plurality of data including the converted sewing data and data related to the converted sewing data is changed according to the data reading sequence in said another sewing means. Consequently, the plurality of data can properly be read in said another sewing means. The sewing data converting device is preferably provided with all of the data sequencing means, the data adding means, and the display data originating means together.

BRIEF DESCRIPTION OF THE DRAWINGS

Other objects, features and advantages of the present invention will become clear upon reviewing the following description of preferred embodiments thereof, made with reference to the accompanying drawings, in which:

FIGS. 9A and 9B schematically show the data structures of the unconverted and converted sewing data respectively;

FIGS. 15A and 15B schematically show the data structure of the sewing data stored in the memory card in the sewing data converting device of an eighth embodiment in accordance with the invention; and FIGS. 16A and 16B are similar to FIGS. 15A and 15B, showing a ninth embodiment of the invention.

DETAILED DESCRIPTION OF THE PREFERRED EMBODIMENTS

Figure 5:
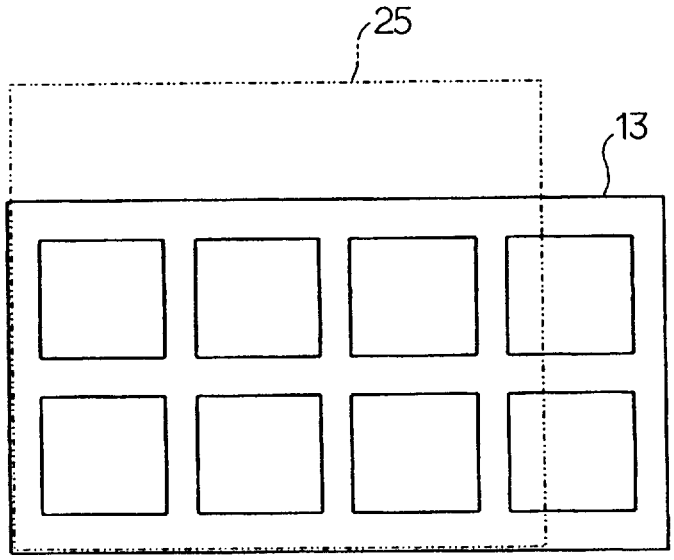
FIG. 5 shows the configuration of the screen of the LCD.
Figure 6:
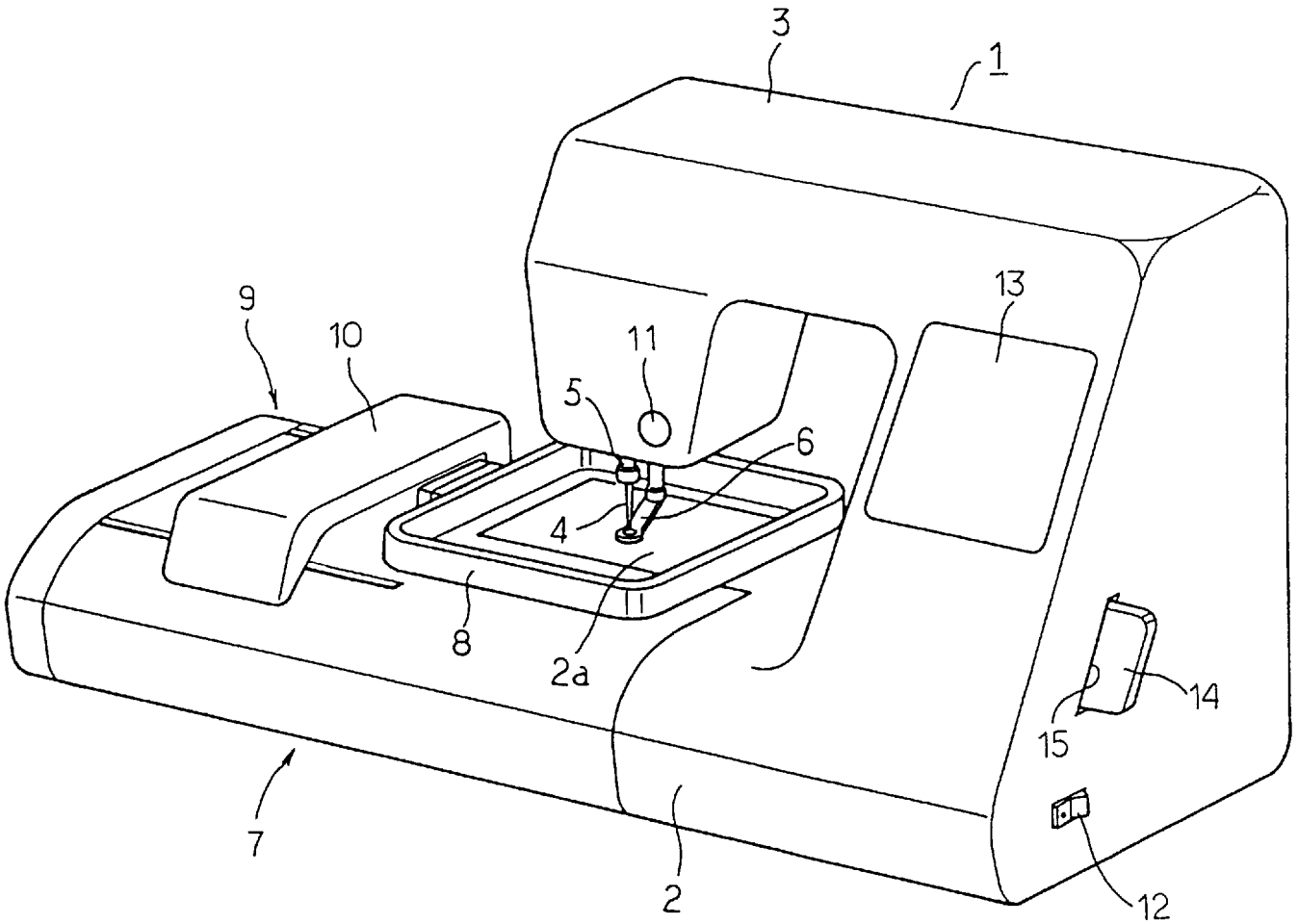
FIG. 6 is a perspective view of an embroidery machine.

A first embodiment will be described with reference to FIGS. 1 to 6. Household embroidery machine are employed as the sewing means in the first embodiment. Referring first to FIG. 6, an overall embroidery machine 1 serving as one of the sewing means is schematically shown. The embroidery machine 1 comprises a sewing bed 2 and an arm 3 formed integrally with and extending over the bed 2. A needle bar 5 having a sewing needle 4 is provided on a distal end of the arm 3. The distal end of the arm 3 is also provided with a ring-shaped presser foot 6 through which the sewing needle 4 passes. The presser foot 6 applies a suitable force to a workpiece cloth (not shown) to bias a part of the workpiece cloth through which the needle 4 passes. A throat plate 2*a* is mounted on an upper surface of the bed 2 so as to correspond to the needle bar 5. A shuttle mechanism (not shown) is provided at a position under the throat plate 2*a* in the bed 2. The needle bar 5, the shuttle mechanism, etc. are synchronously driven by a sewing machine motor (not shown) so that a sewing operation is executed.

An embroidering unit 7 is detachably attached to a left-hand end of the bed 2. The embroidering unit 7 comprises an embroidery frame 8 for holding the workpiece cloth and an embroidery frame moving mechanism 9 for moving the embroidery frame 8 horizontally, that is, in an X-axis direction and a Y-axis direction. The embroidery frame 8 is moved by a moving member 10 of the embroidery frame moving mechanism 9 in the Y-axis direction, that is, forward and backward. A Y-axis drive motor (not shown) is provided for moving the embroidery frame 8 in the Y-axis direction. The moving member 10 is moved in the X-axis direction by an X-axis drive motor (not shown). Each of the X-axis and Y-axis drive motors comprises a pulse motor. Consequently, the workpiece cloth held by the embroidery frame 8 can be moved by the embroidery frame moving mechanism 9 to an optional position based on an intrinsic X-Y coordinate system. An embroidering operation is performed when the needle bar 5, shuttle mechanism, presser foot, etc. are driven by the respective drive mechanisms while the workpiece cloth is moved freely relative to the needle bar 5 by the embroidery frame moving mechanism 9. A start/stop key 11 is provided on a front surface of the distal end of the arm 3 as shown in FIG. 6. A power switch 12 is provided on the lower right-hand side surface of the machine main body.

A monochrome liquid crystal display (LCD) 13 is provided on the front surface of the arm 3. The LCD 13 serves as display means for displaying a variety of patterns and messages. A known touch panel is provided on the surface of the LCD 13. The touch panel includes various operation keys as well known in the art. The touch panel comprises a number of transparent electrodes arranged vertically and horizontally and detects where the user touches it, as well known in the art. A pattern selecting screen is displayed on the LCD 13 so that the user selects a desired embroidery pattern. The screen of the LCD 13 is formed into a horizontally long rectangular shape as shown by solid line in FIG. 5. Eight embroidery patterns arranged in two rows and four lines on one screen as shown by square frames in FIG. 5.

A microcomputer-based control device (not shown) is provided in the embroidery machine 1. The control device controls the sewing machine motor, the X-axis and Y-axis drive motors of the embroidery frame moving mechanism, the LCD 13. A ROM built in the control device stores control programs for controlling the embroidering operation and other ordinary sewing operations of the embroidery machine, and a control program for controlling display of the LCD 16, a data processing program for performing various data processes such as readout and edit of embroidery data.

A card insertion slot 15 is provided in the right-hand side wall of the embroidery machine 1. A memory card 14 is detachably inserted into the card insertion slot 15. The memory card 14 stores embroidery data of a number of embroidery patterns. The memory card 14 is connected to the control device when inserted in the card insertion slot 15, so that the data in the memory card 14 is read by the control device. The memory card 14 is called "IC card" or "ROM card" and has a built-in ROM, EEPROM or flush memory (flush EEPROM).

The embroidery data stored in the memory card 14 includes sewing data indicative of movement of the sewing needle for the embroidering operation and display data formed from bit map data required for display of each pattern on the LCD 13. The sewing data stored in the memory card 14 indicates amounts of movement (relative position) of the workpiece cloth in the X-axis and Y-axis directions for every stitch and is composed of a number of sets of X-axis movement data and Y-axis movement data. The control device has a built-in memory such as ROM storing a plurality of embroidery data (internal embroidery data) of embroidery patterns with relatively simple forms.

The embroidery data (sewing data and display data) stored in the memory card 14 has a data format peculiar to the type of the embroidery machine 1. Accordingly, the embroidery data cannot be used in other types of embroidery machines (other sewing means) which have respective data formats and display formats differing from those of the embroidery machine 1 though they have approximately the same hardware arrangement as the embroidery machine 1. In view of these circumstances, a sewing data converting device 16 (see FIGS. 3 and 4) is provided for converting the sewing data stored in the memory card 14 to that for the other embroidery machines (other sewing means).

Figure 3:
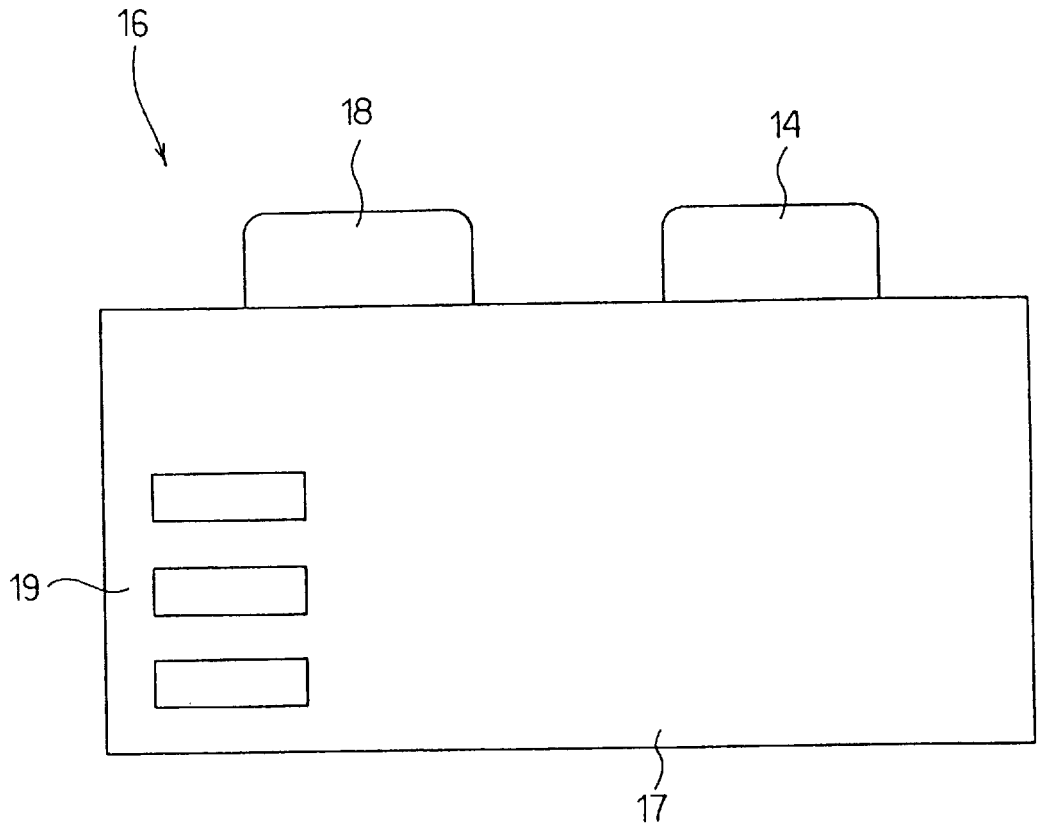
FIG. 3 is a schematic plan view of the sewing data converting device.

FIG. 3 schematically illustrates the sewing data converting device 16. As shown, the sewing data converting device 16 comprises a main body 17 formed into the shape of a rectangular box. One side wall of the main body 17 has an input side connecting slot into which the memory card (IC card) 14 is detachably inserted, and an output side connecting slot into which a memory card 18 for another embroidery machine of the type differing from the embroidery machine 1, neither slot being shown. Furthermore, a plurality of operation keys 19 are provided on the top of the main body 17 for various setting and directing operations.

Figure 4:
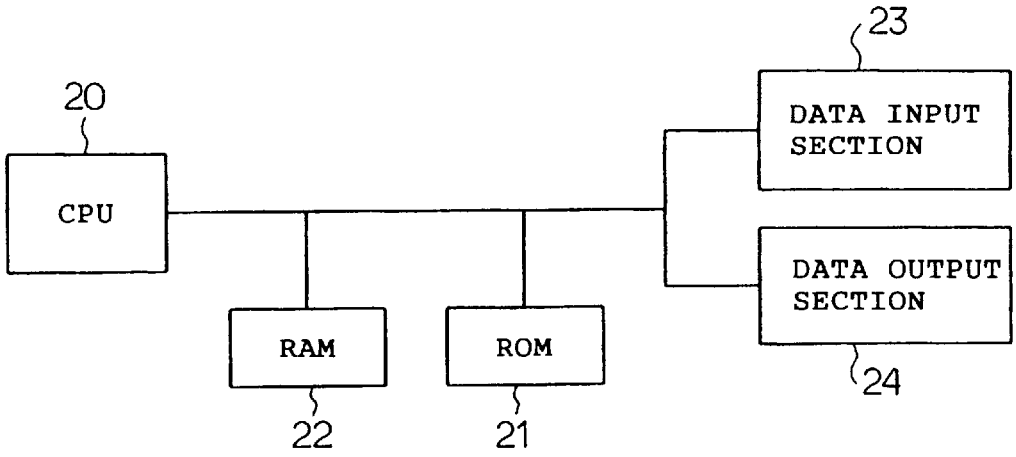
FIG. 4 is a block diagram schematically showing an electrical arrangement of the sewing data converting device.

Referring now to FIG. 4, an electrical arrangement of the sewing data converting device 16 is schematically shown. The sewing data converting device 16 comprises a CPU 20 with a function of controlling the entire operation of the device. A ROM 21, a RAM 20, a data input section 23 and a data output section 24 are connected to the CPU 20. The ROM 21 stores the data conversion program etc. A data storage area for storing pre-conversion and post-conversion data and a working are are set in the RAM 22. The memory card 14 is connected to the data input section 23 when inserted in the input side connecting slot of the main body 17. The memory card 18 of the another embroidery machine is connected to the data output section 24 when inserted in the output side connecting slot of the main body 17.

Upon execution of the data conversion program, the CPU 20 reads the embroidery data (sewing data) stored in the memory card 14 via the data input section 23 and then writes the read data into the RAM 22. The CPU 20 further executes a data converting process and writes the converted embroidery data (sewing data and display data) into the memory card 18 via the data output section 24. Since the converted embroidery data is written into the memory card 18, the memory card 18 comprises a built-in EEPROM, flush memory (flush EEPROM), etc.

In the data converting process, the sewing data read from the memory card 14 is converted to the sewing data adapted for the data format of the another embroidery machine, as described above. In addition to this, display data according to the display format of the another embroidery machine is originated from the sewing data read from the memory card 14 as will be described later. Thus, the CPU 20 serves as data originating means in the invention.

The operation of the sewing data converting device will now be described with reference to FIGS. 1 and 2. The another embroidery machine of the type differing from the embroidery machine 1 is provided with approximately the same hardware arrangement as that of the embroidery machine 1 though differing in the data format, display format, etc. from the embroidery machine 1. Accordingly, when the memory card 18 is inserted into a card insertion slot of the another embroidery machine, the embroidery patterns are displayed on the LCD 25 (shown by two dot chain line in FIG. 5) on the basis of the display data stored in the memory card 18. Furthermore, the sewing operation is executed on the basis of the sewing data of the embroidery pattern selected by the user. As shown in FIG. 5, the LCD of the another embroidery machine has a screen vertically longer than the screen of the LCD 13 of the embroidery machine 1 and an area differing from that of the LCD 13. The LCD 25 of the another embroidery machine has the number of dots per embroidery pattern differing from that of the LCD 13 of the embroidery machine 1.

Figure 1:
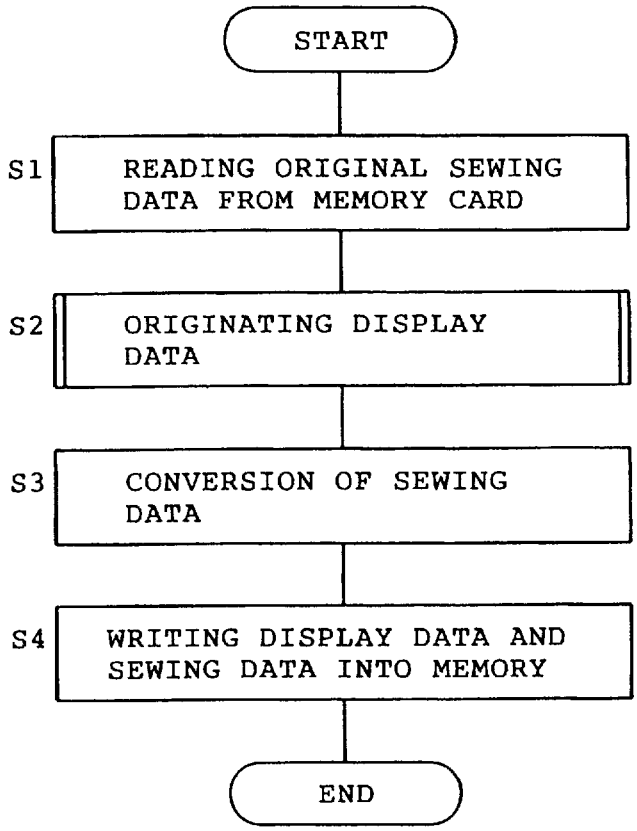
FIG. 1 is a flowchart explaining the procedure of a sewing data converting process in the sewing data converting device of a first embodiment in accordance with the present invention.

Referring to FIG. 1, the procedure for the data converting process executed by the CPU 20 of the data converting device 16 is schematically shown. The user inserts the memory card 14 into the input side connecting slot of the main body 17 and inserts the memory card 18 of the another embroidery machine into the output side connecting slot. When the user then operates the operation key 19, to instruct execution of the data converting process. Then, at step S1, the CPU 20 reads the original or unconverted embroidery data from the memory card 14, writing the read data into the RAM 22. The CPU 20 then advances to step S2 to originate the display data from the embroidery data stored in the RAM 22, writing the originated display data into the RAM 22. A process for originating the display data will be described in detail later. At step S3, a process for converting the unconverted embroidery data so that the embroidery data is adapted for the data format of the another embroidery machine. The converted embroidery data is stored in the RAM 22. Since this data converting process is known in the art, the description thereof is eliminated. At step S4, the CPU 20 executes a process for writing into the memory card 18 the converted embroidery data (sewing data and display data) stored in the RAM 22 into the memory card 18.

Figure 2:
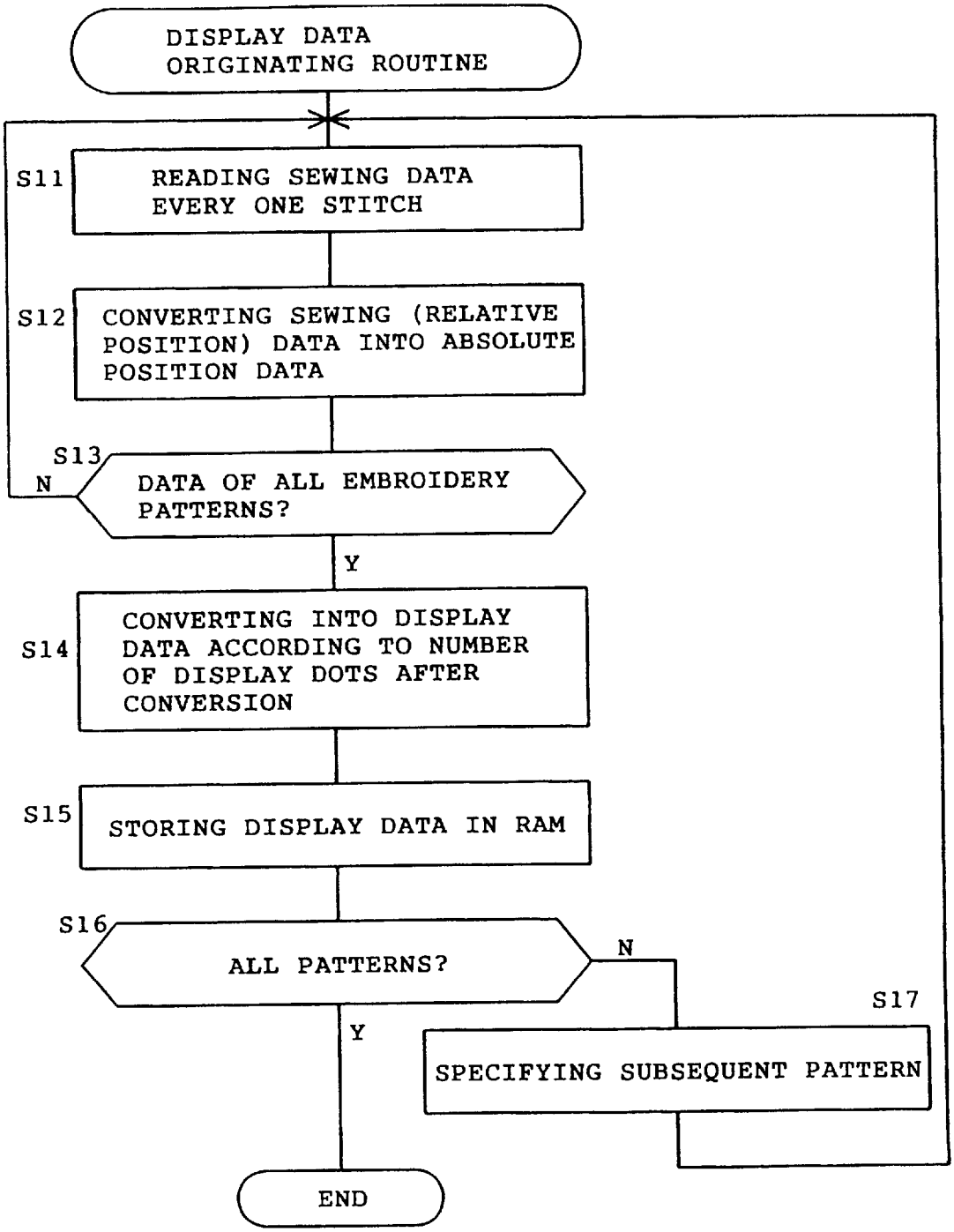
FIG. 2 is a flowchart explaining the procedure of originating display data.

Referring now to FIG. 2, the procedure for originating the display data at step S2 of FIG. 1 is shown. First, the sewing data for one stitch is read at step S11 and then, the read sewing data (the relative position data) is converted to absolute position data at step S12. The absolute position data is position data representative of the form of the pattern on a coordinate plane of 1000 dot 1000 dot assumed in the RAM 22, for example. The processes at steps S11 and S12 are executed for all the sewing data of one embroidery pattern (step S13).

At step S14, shape data set on the coordinate plane assumed as described above is reduced and enlarged to be converted into display data or bit map data according to the display area (the number of dots in the ordinate and abscissa). The converted display data is stored in the RAM 22 at step S15. The CPU 20 then judges whether the display data has been originated from the sewing data of all the embroidery patterns, at step S16. When the CPU 20 judges that the display data has not been originated for all the embroidery patterns (NO at step S16), an embroidery pattern to be subsequently processed is specified at step S17 and thereafter, the processes beginning at step S11 are repeated for the specified embroidery pattern. Upon completion of display data origination for all the embroidery patterns, the CPU 20 judges in the affirmative at step S16, finishing the display data originating process.

According to the above-described embodiment, the display data related to the converted sewing data is originated when the sewing data in one embroidery machine 1 is converted to the sewing data for another embroidery machine. In this case, the display data is adapted for the display format of the another embroidery machine and originated from the sewing data. Consequently, the display data can be approximated more to the shape of the embroidery pattern. Thus, even if the display format of the another embroidery machine differs from that of the one embroidery machine, a proper displaying operation can be executed on the basis of the originated display data. Consequently, a new value can be added to the converted sewing data to thereby improve the usability of the data.

Figure 7:
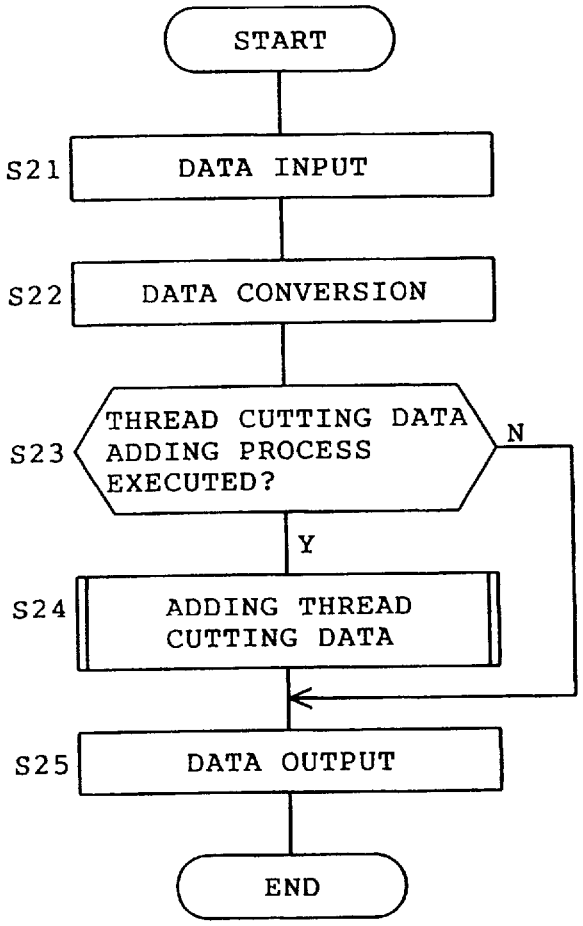
FIG. 7 is a view similar to FIG. 1, showing the sewing data converting device of a second embodiment in accordance with the invention.
Figure 8:
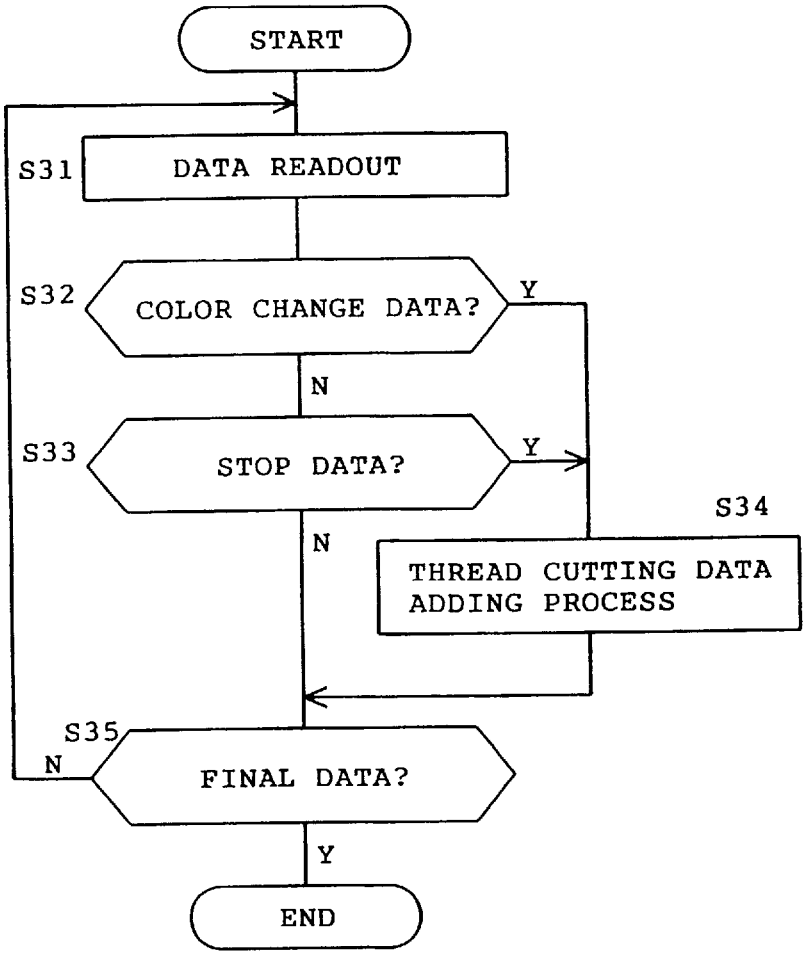
FIG. 8 is a flowchart explaining in detail the contents of step S24 in FIG. 7.

FIGS. 7 to 9 illustrate a second embodiment of the invention. The identical parts in the second embodiment are labeled by the same reference symbols as in the first embodiment. In the second embodiment, the embroidery machine (not shown) of the type differing from the embroidery machine 1 is provided with a thread cutter for automatically cutting an embroidery thread (needle thread). In brief, the thread cutter comprises a thread cutting knife and means for moving the knife. The thread cutter is controlled by the control device.

The control device of the another embroidery machine operates the thread cutter based on thread cutting data included in the sewing data. The thread cutting data is used when a sewing operation for one color of thread has been finished and the thread is then changed to another color of thread by the user and when the sewing operation is stopped. Japanese patent application No. 8-244760 filed by the assignee of the present invention discloses the construction of the thread cutter.

The sewing data converting device 16 of the second embodiment reads the sewing data from the memory card 14 via the data input section 23 and writes the read data into the RAM 22 in the same manner as in the first embodiment. The data converting process is then executed and the converted sewing data is written via the data output section 24 into the memory card 18. In the second embodiment, data for the thread cutting operation by the thread cutter, namely, the thread cutting data can be added to the converted sewing data. Thus, the converting device 16 serves as data adding means. Whether the thread cutting data is to be added can be set by the operation key 19.

FIG. 7 shows the procedure for the data conversion executed by the CPU 20 of the converting device 16. First, the user inserts the memory card 14 into the input side connecting slot of the main body 17 and further inserts the memory card 18 of the another embroidery machine into the output side connecting slot. The user then operates the operation key 19 to set an operation mode for adding the thread cutting data. The user further operates another operation key 19 to instruct start of the data converting process.

The original sewing data is read from the memory card 14 to be written into the RAM 23 at step S21. The CPU 20 then executes the sewing data converting process at step S22 and stores the converted sewing data in the RAM 22. At step S23, the CPU 20 judges whether the thread cutting process is to be executed. When the thread cutting data is to be added (YES at step S23), the CPU 20 executes a process for adding the thread cutting data at step S24. The CPU 20 advances to step S25 to write the converted sewing data stored in the RAM 22 into the memory card 18 when the thread cutting data adding process has been completed or when the thread cutting data is not added (NO at step S23).

The thread cutting data adding process will be described in detail with reference to FIGS. 8 to 9B. FIG. 8 shows the procedure or a subroutine for adding the thread cutting data as executed at step S24. FIG. 9A shows the data structure of the unconverted sewing data and FIG. 9B shows the data structure of the converted sewing data. The unconverted sewing data includes data indicative of an amount of movement of the embroidery frame 8 for every stitch (first stitch data, second stitch data, . . . ), color change data, stop data, final data, etc. In the above-described process at step S22 in FIG. 7, the sewing data is simply changed to the data format adapted for the another embroidery machine. Thus, the RAM 22 stores the sewing data in the intermediate state.

The intermediate sewing data stored in the RAM 22 is sequentially read every one stitch at step S31 in FIG. B. The CPU 20 judges whether the read data is the color change data, at step S32. When the read data is not the color change data (NO at step S32), the CPU 20 advances to step S33 to judge whether the read data is the stop data. Judging that the read data is either color change data or stop data (YES at step S32 or S33), the CPU 20 advances to step S34 to execute the thread cutting data adding process, that is, to add the thread cutting data to the tail of the read data.

When the read data is neither color change data nor stop data (NO at step S33) or after the thread cutting data adding process has been executed, the CPU 20 judges at step S35 whether the read data is the final data. The processes from step S31 to step S35 are repeatedly executed until the final data is read. As the result of the above-described processing, the thread cutting data are added to predetermined locations of the converted sewing data as shown in FIG. 9B. The sewing operation executed by the different type of embroidery machine includes an automatic thread cutting operation by the thread cutter when the sewing operation is executed by the different type of embroidery machine on the basis of the converted sewing data.

According to the second embodiment, operation data for operating the thread cutter peculiar to the embroidery machine of the type differing from the embroidery machine 1 is added to the converted sewing data when the original data for the embroidery machine 1 is converted to the sewing data for the different type of embroidery machine. The thread cutting operation which is not executed by the embroidery machine 1 can be executed on the basis of the converted sewing data. The sewing data converting device 16 of the second embodiment can originate such proper sewing data that the function peculiar to the different type of embroidery machine can sufficiently be accomplished. Consequently, a new value can be added to the converted sewing data to thereby improve the usability of the data.

Figure 10:
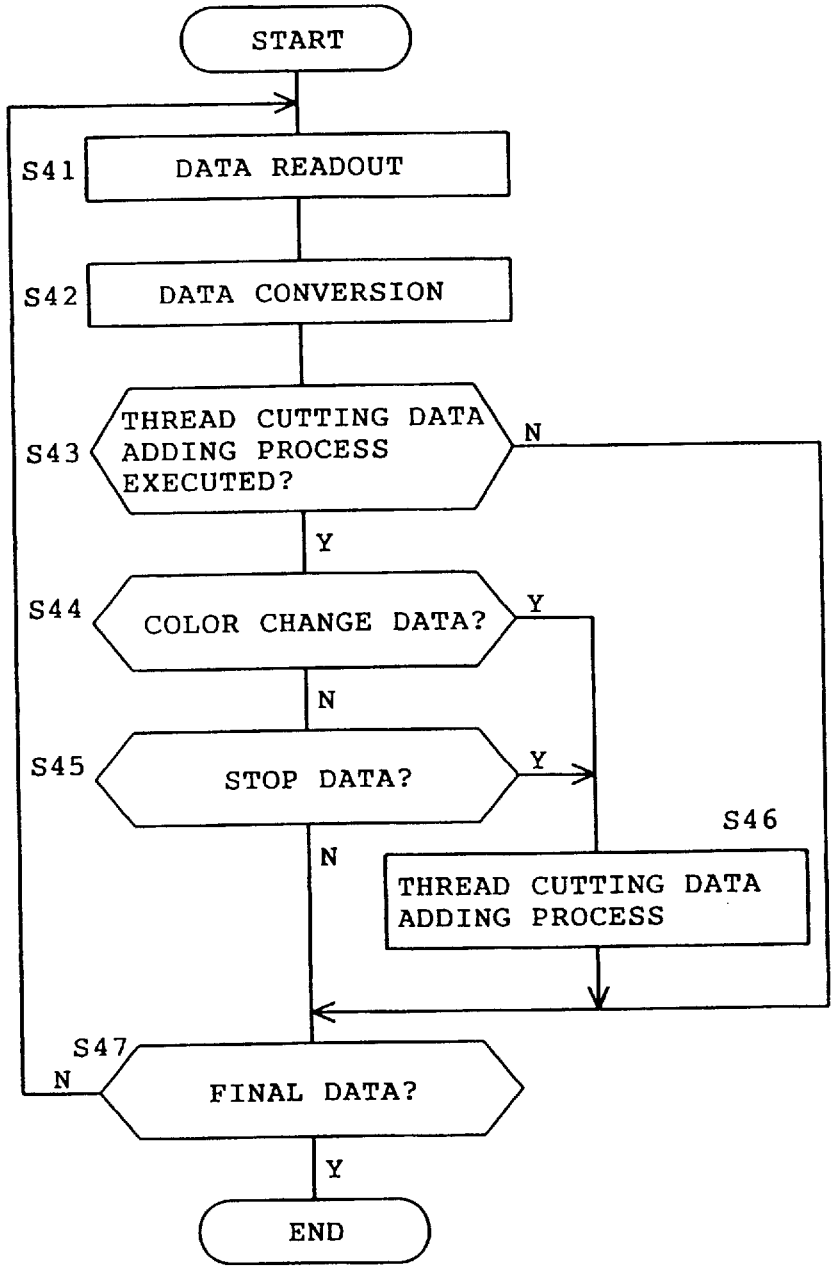
FIG. 10 is a flowchart explaining the procedure of a sewing data converting process in the sewing data converting device of a third embodiment in accordance with the present invention.

FIG. 10 illustrates the procedure for data conversion executed by the sewing data converting device of a third embodiment. The third embodiment differs from the second embodiment in that the conversion of data format and the process for addition of thread cutting data are continuously executed every time the data for one stitch is read.

More specifically, the original sewing data stored in the RAM 22 is sequentially read for every one stitch at step S41, and the data conversion is executed at step S42. The CPU 20 then judges whether the embroidery machine is set in a thread cutting data adding mode, at step S43. When the machine is set in the thread cutting data adding mode (YES at step S43), the CPU 20 advances to step S44 to judge whether the converted data is the color change data. When the converted data is not the color change data (NO at step S44), the CPU 20 judges at step S45 whether the data is the stop data. When the data is either color change data or stop data (YES at step S44 or S45), the CPU 20 advances to step S46 to execute the thread cutting data adding process, that is, to add the thread cutting data to the tail of the read data. On the other hand, the CPU 20 judges at step S47 whether the final data has been read when the read data is not the stop data, either (NO at step S45), when the machine is not in the thread cutting data adding mode (NO at step S43), or after the thread cutting data adding process has been executed.

The CPU 20 repeats the processes from step S41 to step S47 until the final data is read.

According to the third embodiment, the sewing data conversion and the addition of thread cutting data are executed at the same time, and the thread cutting data are added to the predetermined locations of the converted sewing data. The sewing operation executed by the different type of embroidery machine includes an automatic thread cutting operation by the thread cutter when the sewing operation is executed by the different type of embroidery machine on the basis of the converted sewing data. Consequently, substantially the same effect can be achieved from the third embodiment as from the second embodiment.

Figure 11:
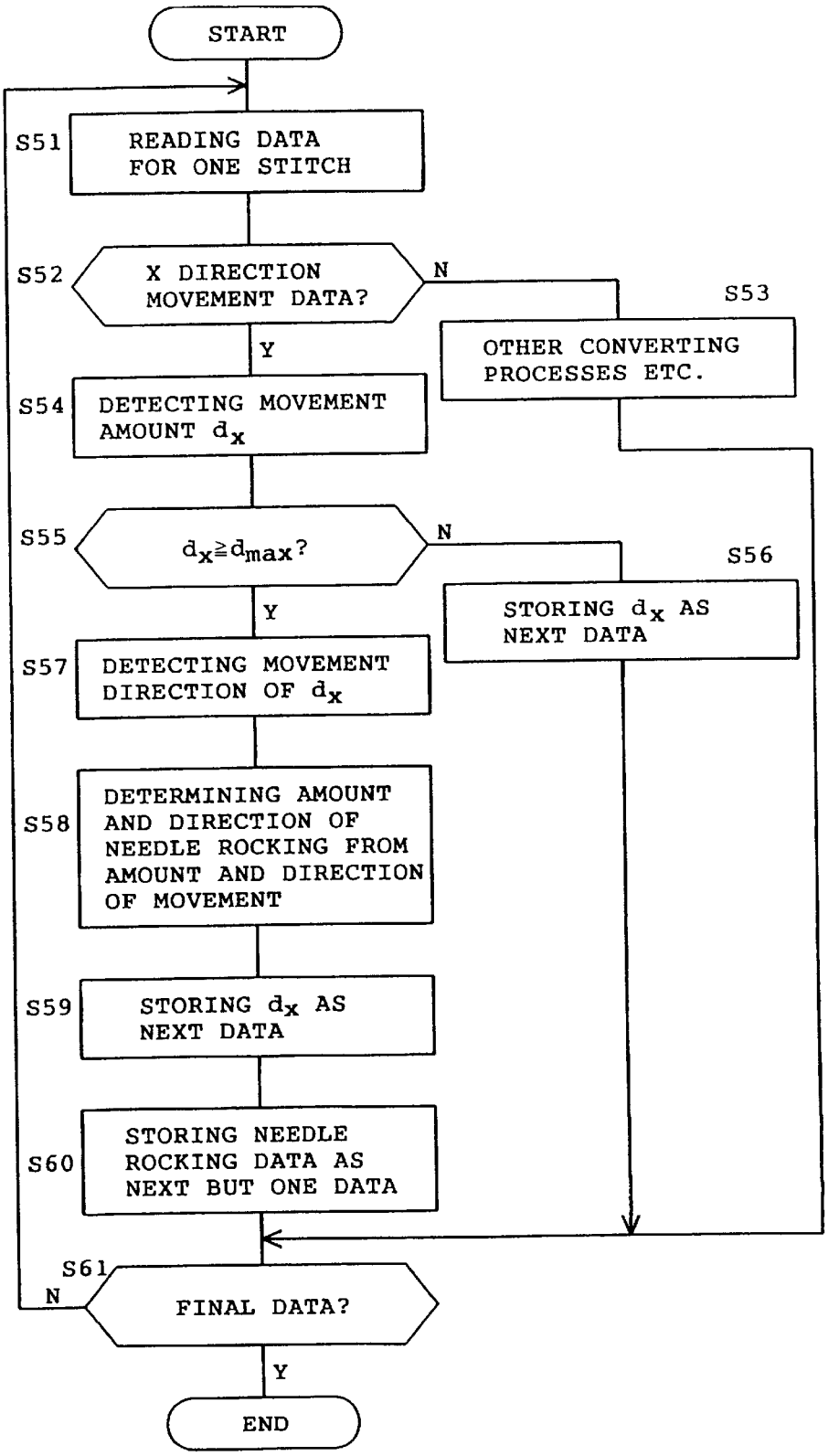
FIG. 11 is a view similar to FIG. 10, showing the sewing data converting device of a fourth embodiment in accordance with the invention.

FIG. 11 illustrates a fourth embodiment of the invention. In the fourth embodiment, the embroidery machine of the type different from the embroidery machine 1 is provided with a known electronically controlled needle rocking mechanism for rocking the sewing needle leftward and rightward, that is, in the direction of X axis. The needle rocking mechanism is controlled by the control device, for example, to perform a needle rocking operation pertaining the needle thread. Although the needle rocking mechanism is provided in the embroidery machine 1, the mechanism is not used in a usual embroidering operation on the basis of the sewing data.

Inertia due to the self-weight of the embroidery frame 8 of the embroidery frame moving mechanism 9 reduces the precision in stop thereof in the embroidery machine 1 when the rotational speed of the pulse motor is increased with an increase in the amount of movement of the embroidery frame 8. In view of this drawback, data of amount of movement in the sewing data is adjusted so that a stop error is corrected. However, the construction of the embroidery frame moving mechanism differs depending upon the types of embroidery machines and accordingly, the above-mentioned inertia differs from one type of embroidery machine to another. Accordingly, when the sewing data is simply converted, an error sometimes occurs in the stop position of the embroidery frame. This spoils the shape of the embroidery pattern.

In view of the above-described problem, the sewing data converting device 16 of the fourth embodiment adds data for a needle rocking operation executed by the needle rocking mechanism so as to absorb the error, namely, needle rocking data. The sewing data converting device 16 thus has a function as data adding means.

FIG. 11 shows the procedure for the data conversion executed by the CPU 20 of the sewing data converting device 16 or the processing after the original sewing data is read from the memory card 14 and written into the RAM 22. First, the sewing data for one stitch is read from the RAM 22 at step S51. The CPU 20 judges at step S52 whether the read data is data of movement of frame in the X direction or leftward and rightward. The converting processes are normally executed at step S53 when the read data is not the X direction movement data, that is, when the read data is data of movement of the frame in the Y direction, the stop data or the thread change data (NO at step S52).

On the other hand, when the read data is the x direction movement data (YES at step S52), the CPU 20 advances to step S54 to detect the absolute value of an amount $d_x$ of movement in the X direction (vector data). The CPU 20 then judges at step S55 whether the absolute value of the movement amount $d_x$ is at or above a reference value $d_{max}$. The reference value $d_{max}$ is set so that a stop error occurs when the absolute value is at or above the reference value $d_{max}$. Accordingly, when the movement amount $d_x$ is below the reference value $d_{max}$ (NO at step S55), the movement amount $d_x$ is stored with its data format converted (step S56).

The CPU 20 detects the direction of movement (rightward or leftward) at step S57 when the movement amount $d_x$ is at or above the reference value $d_{max}$ (YES at step S55). The CPU 20 calculates an amount of needle rocking and direction thereof from the detected movement direction and moment amount $d_x$ at step S58. The CPU 20 then converts the data format of the vector data $d_x$ as the subsequent data and stores the converted data at step S59. The CPU 20 then adds the need rocking data determined at step S58 as a further subsequent data and stores the resultant data. The above-described processing is repeated until the final data is read (step S61). The arrangement of the fourth embodiment other than described above is substantially the same as that in each of the first to third embodiments.

The needle rocking operation which is not included in the original sewing data for the embroidery machine 1 is performed in addition to the frame movement when the sewing operation is executed on the basis of the sewing data converted as described above in the different type of embroidery machine. Accordingly, even when the difference in the construction of the embroidery frame moving mechanism between these embroidery machines results in an error in the stop position of the embroidery frame, the error is absorbed by the needle rocking operation and a well-finished embroidery pattern can be obtained. Thus, since the needle rocking data can be added in the conversion of the sewing data, a new value can be added to the converted sewing data and its usability can be improved.

Figure 12:
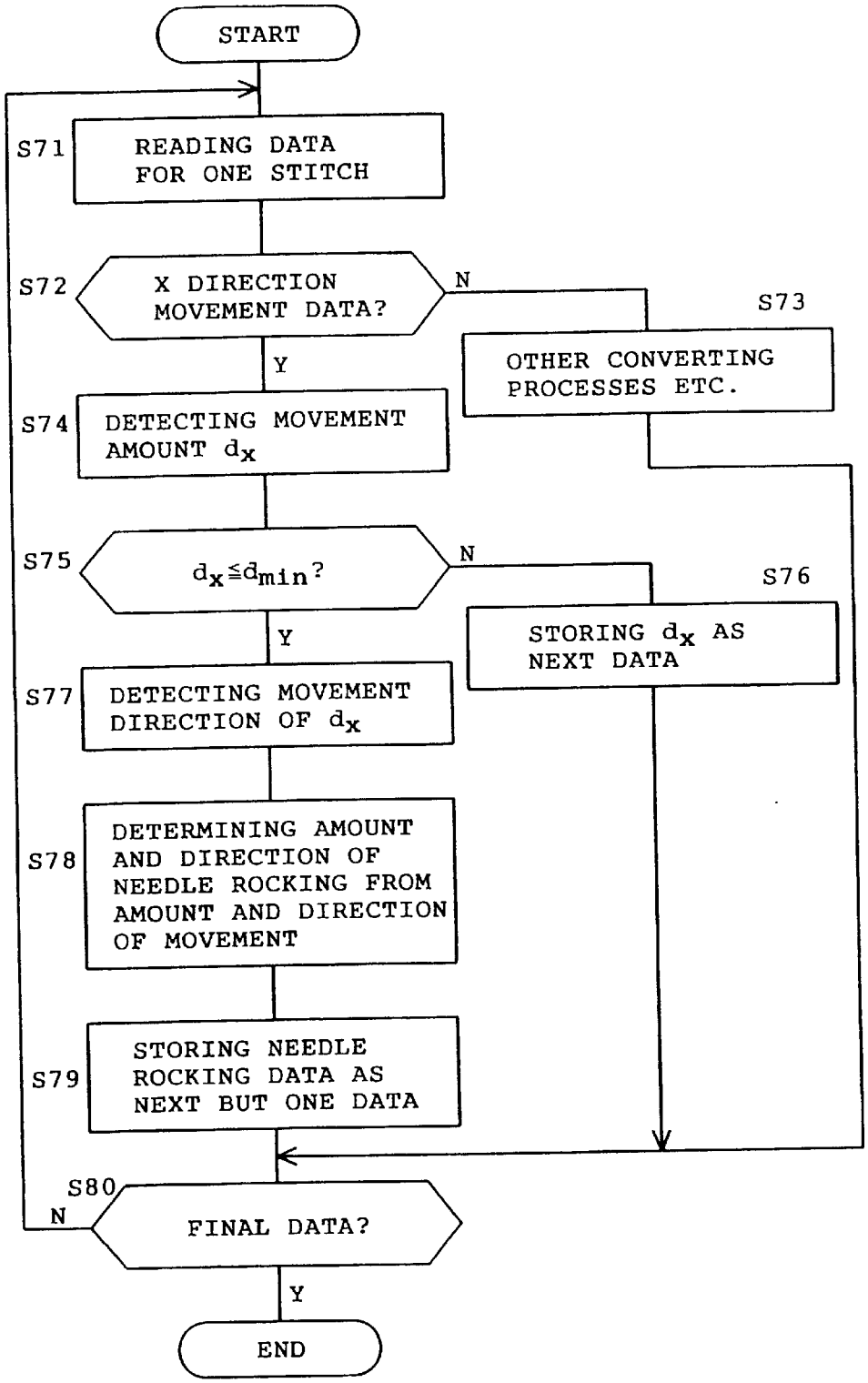
FIG. 12 is a view similar to FIG. 10, showing the sewing data converting device of a fifth embodiment in accordance with the invention.

FIG. 12 illustrates a fifth embodiment of the invention. In the fifth embodiment, too, the needle rocking data is added to the converted sewing data when the sewing data for the embroidery machine 1 is converted to that for the different type of embroidery machine. As the condition for the addition of needle rocking data, however, the needle rocking data is originated instead of the X direction movement data when an amount of movement of the embroidery frame 8 in the X direction is small.

The embroidery frame moving mechanisms of various types of embroidery machines have different motor resolutions, link ratios, etc. Accordingly, a slight amount of feed of the embroidery frame is rendered impossible in the different type of embroidery machine although it is rendered possible in the embroidery machine 1. Furthermore, the embroidery frame moving mechanisms of various types of embroidery machines have different response speeds of movement of the embroidery frames. Accordingly, a sewing time is sometimes shortened when the needle bar 5 side is sometimes moved a slight amount by the needle rocking rather than when the embroidery frame 8 is moved. The fifth embodiment provides a solution to cope with the above case.

More specifically, the sewing data for one stitch is read from the RAM 22 at step S71 in FIG. 12. The CPU 20 judges at step S72 whether the read data is data of movement of frame in the X direction or leftward and rightward. The converting processes are normally executed at step S73 when the read data is not the X direction movement data, that is, when the read data is data of movement of the frame in the Y direction, the stop data or the thread change data (NO at step S72).

On the other hand, when the read data is the X direction movement data (YES at step S72), the CPU 20 advances to step S74 to detect the absolute value of an amount $d_x$ of movement in the X direction. The CPU 20 then judges at step S75 whether the absolute value of the movement amount $d_x$ is at or above the reference value $d_{max}$. The reference value $d_{max}$ is set so that the needle rocking is advantageous of moving the embroidery frame 8 when the absolute value is at or above the reference value $d_{max}$. Accordingly, when the movement amount $d_x$ exceeds the reference value $d_{max}$ (NO at step S75), the movement amount $d_x$ is stored with its data format converted (step S76).

The CPU 20 detects the direction of movement at step S77 when the movement amount $d_x$ is at or below the reference value $d_{max}$(YES at step S75). The CPU 20 calculates an amount of needle rocking and direction thereof from the detected movement direction and moment amount $d_x$ at step S78. The CPU 20 then stores the needle rocking data, instead of the X direction movement data, at step S79. The above-described processing is repeated until the final data is read (step S80), and thereafter the data conversion is completed. The arrangement of the fifth embodiment other than described above is substantially the same as that in the fourth embodiment.

According to the fifth embodiment, the X direction movement data defining a slight amount of movement of the embroidery frame is replaced with the needle rocking data in the conversion of the sewing data when the slight amount of movement is impossible or a higher sewing efficiency is provided by the needle rocking rather than by moving the embroidery frame depending upon the different types of the embroidery machines. Consequently, a new value can be added to the converted sewing data and its usability can be improved.

Figure 13:
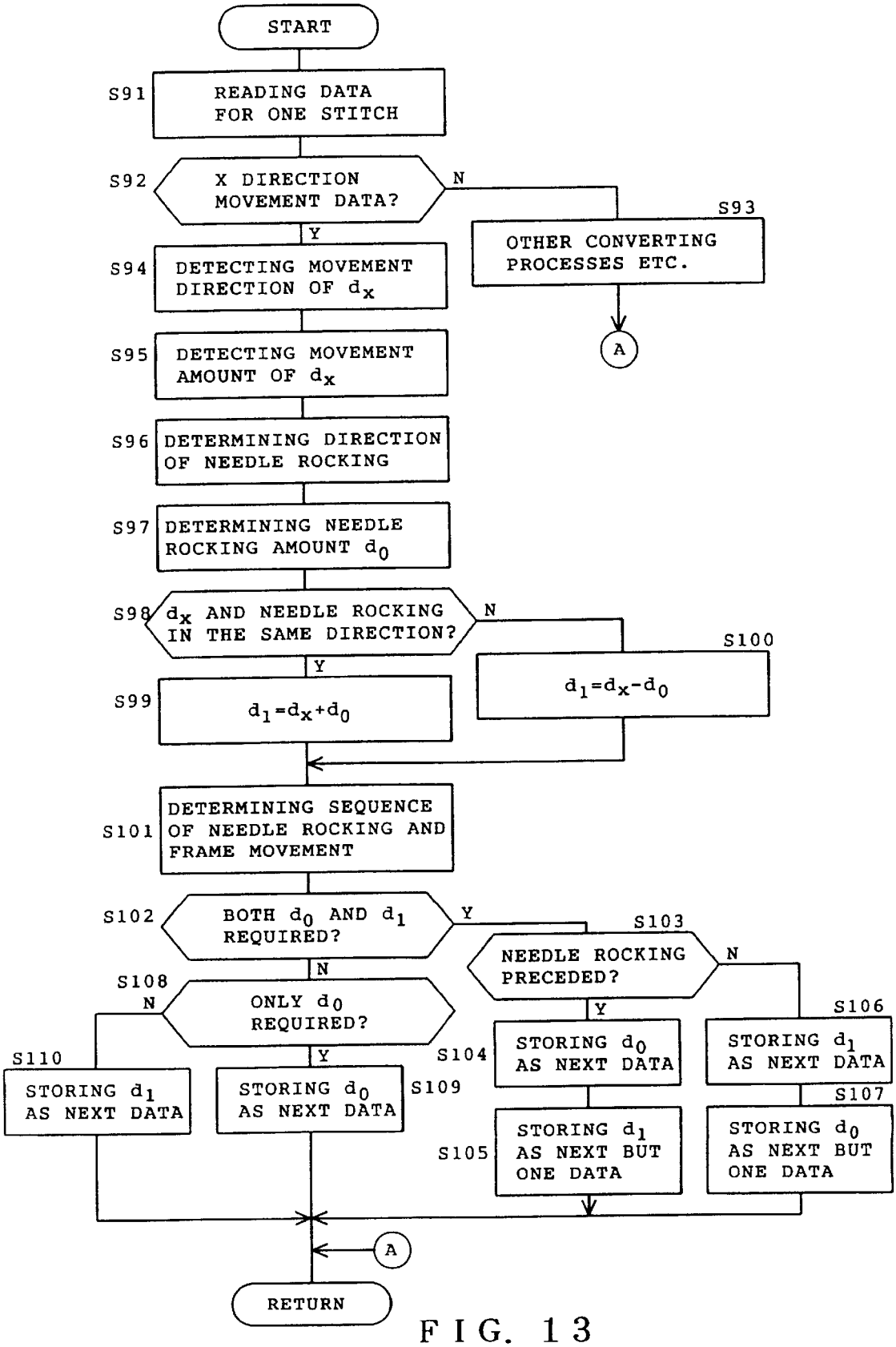
FIG. 13 is a view similar to FIG. 10, showing the sewing data converting device of a sixth embodiment in accordance with the invention.

FIG. 13 illustrates a sixth embodiment. The sewing data converting device 16 of the sixth embodiment is directed to the conversion of the sewing data for the embroidery machine 1 to that for another embroidery machine with the needle rocking mechanism. The converting device 16 positively adds the needle rocking data to the converted sewing data irrespective of the purpose of correction of error as in the fourth and fifth embodiments, whereby the device 16 provides the converted sewing data on the basis of which the sewing operation is executed both by the movement of the embroidery frame 8 and by the needle rocking.

More specifically, the sewing data for one stitch is read from the RAM 22 at step S91 in FIG. 13. The CPU 20 judges at step S92 whether the read data is data of movement of frame in the X direction or leftward and rightward. The converting processes are normally executed at step S93 when the read data is not the X direction movement data (NO at step S92). On the other hand, when the read data is the X direction movement data (YES at step S92), the CPU 20 advances to step S94 to detect the direction of movement at step S94 and the absolute value of an amount $d_x$ of movement in the X direction at step S95.

The CPU 20 then determines a suitable direction in which the needle bar 5 is rocked, at step S96 and a suitable amount $d_0$ of needle rocking at step S97. The CPU 20 then calculates an amount $d_1$ of the X direction movement of the embroidery frame 8 at steps 98 to 100. When the movement by the X direction movement amount $d_x$ and the rocking of the needle bar 5 are in the same direction (YES at step S98), the movement amount $d_1$ is equal to the sum of $d_x$ and do (step S99). When the of movement by the X direction movement amount $d_x$ is in the direction opposite to the rocking of the needle bar 5 (NO at step S98), the movement amount $d_1$ is equal to the difference between $d_x$ and $d_0$ (step S100).

After the direction of needle rocking, needle rocking amount $d_0$, and movement amount $d_1$ of the embroidery frame 8 have been determined, the CPU 20 determines a preferable sequence of the needle rocking operation and the movement of the embroidery frame at step S101. The CPU 20 then judges whether both of the needle rocking and the frame movement is required, at step S102. When both of the operations are required (YES at step S102), the CPU 20 judges whether the needle rocking operation should precede the frame movement, at step S103. When the needle rocking should precede (YES at step S103), the needle rocking data $d_0$ is stored as the data to be subsequently executed at step S104) and the X direction movement data $d_1$ of the embroidery frame 8 is stored as the data to be executed subsequently to the needle rocking data $d_0$ at step S105. When the needle rocking is executed subsequently to the frame movement (NO at step S103), the data $d_1$ is stored as the data to be subsequently executed at step S106 and the data $d_0$ is stored as the data to be executed subsequently to the data $d_1$ at step S107.

On the other hand, when either needle rocking or frame movement is required (NO at step S102), the CPU 20 judges whether only the needle rocking is required, at step S108. When only the needle rocking is required (YES at step S108), the needle rocking data $d_0$ is stored as the data to be subsequently executed at step S109. When only the frame movement is required (NO at step S108), the X direction movement data $d_1$ is stored as the data to be subsequently executed at step S110. The above-described processing is repeated until the final data is read. Then, the data conversion is completed. The arrangement of the sixth embodiment other than described above is substantially the same as that in each of the fourth embodiment. Consequently, a new value can be added to the converted sewing data and its usability can be improved.

The sewing data can be copied by using the sewing data converting device 16 of each of the foregoing embodiments. However, an embroidery pattern of a character of animated cartoon protected by the copyright is prohibited from being unfairly copied. When the sewing data is unfairly converted or copied by the procedure or program as shown in FIG. 13, it is preferable that a normal embroidery pattern cannot be formed by using the unfairly converted sewing data. More specifically, the CPU 20 judges whether the sewing data is being unfairly converted or copied. For example. The judgment is based on ID information stored in each memory card 14 to indicate whether each of the embroidery patterns (sewing data) is protected by the copyright. When the CPU 20 judges that the sewing data is being unfairly converted or copied, data of an excessively large needle rocking operation is inserted into the sewing data, for example. An embroidery pattern has an unnecessary space, overlapped portion or projected portion during the sewing operation based on the unfairly converted sewing data, whereby a fine embroidery pattern cannot be formed. When the main body 17 of the sewing data converting device 16 is provided with a display, it is preferred that a message informing that the sewing data is being unfairly converted or copied is displayed on the display. It is further preferred that the data conversion is not executed after the CPU 20 displays the message on the display to inform the user of the unfair copying or that a normal embroidery pattern cannot be formed as described above.

Figure 14:
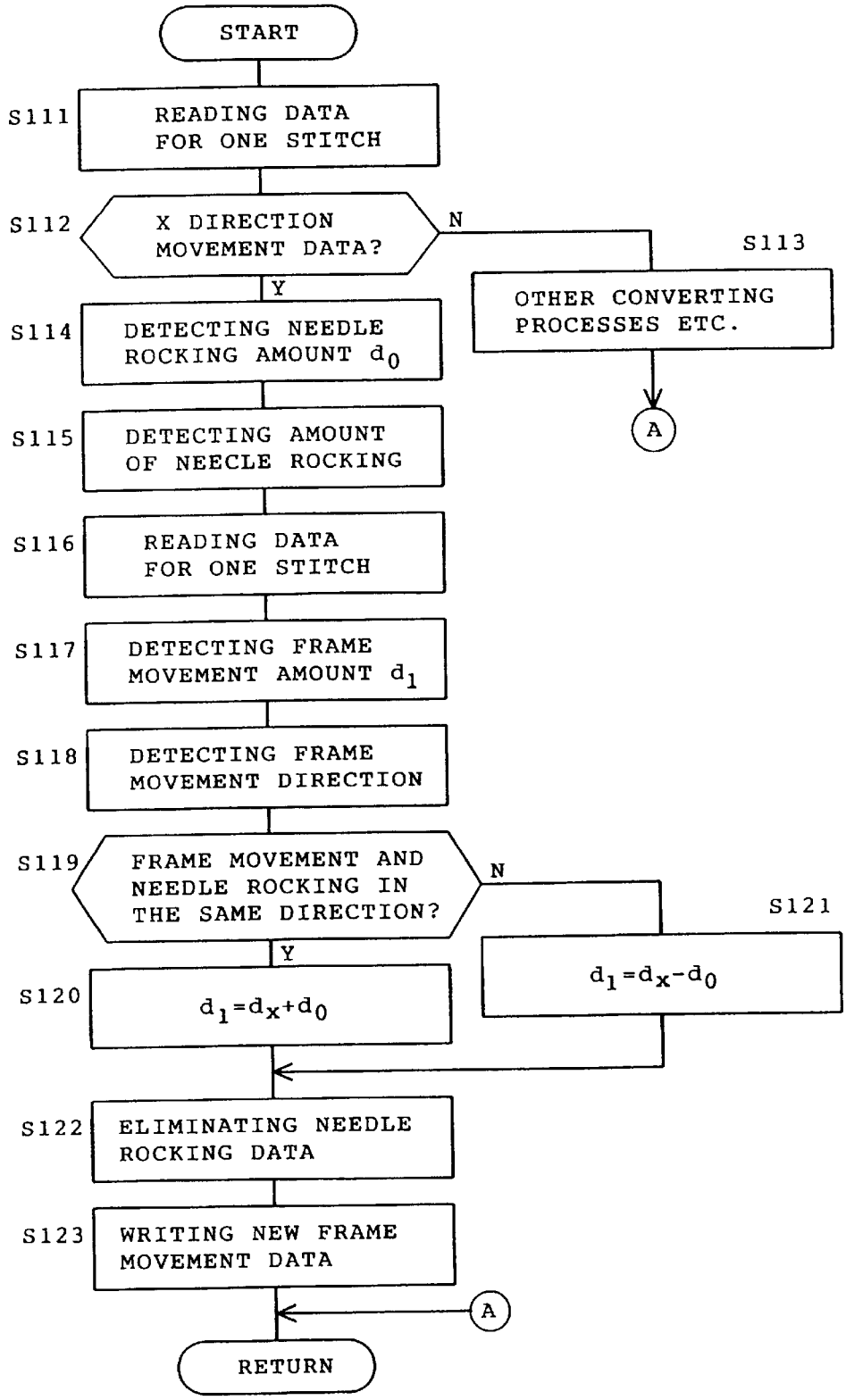
FIG. 14 is a view similar to FIG. 10, showing the sewing data converting device of a seventh embodiment in accordance with the invention.

FIG. 14 illustrates a seventh embodiment of the invention. FIG. 14 shows the procedure of a data converting program used in the case where sewing data including therein needle rocking data is converted to another sewing data on the basis of which the sewing operation is executed only with the movement of the embroidery frame 8 without the needle rocking. In this case, the original sewing data has the X direction movement data at the tail of the needle rocking data.

The sewing data for one stitch is read at step S111 in FIG. 14. The CPU 20 judges at step S112 whether the read data is the needle rocking data. When the read is not the needle rocking data (NO at step S112), the converting processes are normally executed at step S113. On the other hand, when the read data is the needle rocking data (YES at step S112), the CPU 20 detects an amount of needle rocking (amount of movement) do at step S114 and the direction of movement at step S115. The CPU 20 then reads the subsequent X direction movement data at step S116 and detects an amount of movement $d_1$ at step S117 and the direction of movement at step S118.

The CPU 20 then advances to step S119 to judge whether the direction of needle rocking is the same as the direction of movement of the embroidery frame 8. When the needle rocking and the movement of the embroidery frame 8 are in the same direction (YES at step S119), new X direction movement data $d_x$ is set to be equal to the sum of $d_0$ and $d_1$, at step S120. When the needle rocking is in a direction opposite to the movement of the embroidery frame 8 (NO at step S119), new X direction movement data $d_x$ is set to be equal to the difference between $d_1$ and $d_0$, at step S121. Thereafter, the needle rocking data is eliminated at step S122 and new frame movement data (X direction movement data $d_x$) is written at step S123. The above-described processing is repeated until the final data is read. The data conversion is then completed. The arrangement of the seventh embodiment other than described above is substantially the same as that in the fourth embodiment. According to the seventh embodiment, the sewing data including the needle rocking data can be converted to the sewing data for an embroidery machine of the type provided with no needle rocking mechanism.

FIGS. 15A and 15B illustrate an eighth embodiment, and FIGS. 16A and 16B illustrate a ninth embodiment. In these embodiments, a sequence of a plurality of data including the sewing data to be converted and data related to the sewing data, for example, display data is changed so as to correspond to a sequence of reading of data in another embroidery machine. The sewing data converting device 16 of each of the eighth and ninth embodiments has a function as data sequencing means.

First, the eighth embodiment shown in FIGS. 15A and 15B will be described. The memory card 14 for the embroidery machine 1 stores the display data and sewing data of a plurality of embroidery patterns (patterns 1, 2, 3, . . . ) as shown in FIG. 15A. Each display data has a regular volume (storage capacity), and each sewing data also has a regular volume (storage capacity). That is, each display data has the volume of 20 (address) and each sewing data has the volume of 100 (address). In other words, data address of each display data is regular and data address of each sewing data is also regular. Accordingly, a storage area for the display data is read by the volume of 20 beginning with a first address (1000) when the display data of pattern 1 is read in the embroidery machine 1. A storage area for the sewing data is read by the volume of 100 beginning with a first address (2000) when the sewing data of pattern 1 is read. The display data and sewing data of pattern 2 and subsequent patterns are read substantially in the same manner as described above.

On the other hand, the memory card 18 stores display data and sewing data of a plurality of embroidery patterns (patterns 1, 2, 3, . . . ) in the manner as shown in FIG. 15B. Each display data has a regular volume (storage capacity), and each sewing data also has a regular volume (storage capacity). However, the sewing data is continuous to the display data in each pattern. Accordingly, when the data shown in FIG. 15A is converted to the data shown in FIG. 15B, a sequence for storing the data is changed and end data defining each boundary between two data is added. Each data including the end data constitutes one set of data in the embroidery machine in which the converted sewing data is used.

The ninth embodiment shown in FIGS. 16A and 16B will now be described. The memory card 14 for the embroidery machine 1 stores the display data and sewing data of a plurality of embroidery patterns (patterns 1, 2, 3, . . . ) as shown in FIG. 16A. Each display data has a different volume (variable length data), and each sewing data also has a different volume (variable length data). The display data are sequentially stored so as to each have an optional capacity beginning with address of 1000. Also, the sewing data are sequentially stored so as to each have an optional capacity beginning with address of 2000. First address data are stored at the head of the storage area. The first address data of the display data are stored sequential from the address of 500. The first address data of the sewing data are stored sequentially from the address of 600.

On the other hand, the memory card 18 stores display data and sewing data of a plurality of converted embroidery patterns (patterns 1, 2, 3, . . . ) in the manner as shown in FIG. 16B. First address data for the display data and the sewing data are stored at determined addresses 300 and so forth and 400 and so forth in the same manner as in FIG. 16A. However, storage locations of the display data and the sewing data differ from those in FIG. 16A. More specifically, as shown in FIG. 16B, the data are stored from address 1000 in the sequence of display data of pattern 1, sewing data of pattern 1, display data of pattern 2, sewing data of pattern 2 and so forth. Furthermore, the display data and the sewing data are continuous without margin for each one pattern. When storage locations of the data are changed, address may be adjusted by eliminating marginal memory so that the addresses are put close or, contrarily, by inserting data serving as margin.

According to the eighth and ninth embodiments, the sequence of the sewing data and display data to be converted can be changed so as to correspond to the sequence of reading of data in another embroidery machine when the sewing data for the embroidery machine 1 is converted to the sewing data for the another embroidery machine. Since a plurality of data are properly read in the another embroidery machine, whereupon the usability can be improved.

The sewing data converting device 16 of each of the foregoing embodiments has the function of any one of the display data originating means, the data adding means, and the data sequencing means. However, the sewing data converting device may have the functions of two or three of these means, instead. More specifically, the first embodiment is preferably combined with any one of the second to seventh embodiments. Furthermore, the first embodiment is preferably combined with either eighth or ninth embodiment. Also, one of the second to seventh embodiments is preferably combined with either eighth or ninth embodiment. Additionally, the first embodiment, any one of the second to seventh embodiments, and either eighth or ninth embodiment are preferably combined.

Although the sewing data are stored in the memory cards 14 and 18 in the foregoing embodiments, other storage media such as magnetic disks, for example, floppy disks or hard disks, or optical disks may be used, instead. Furthermore, the sewing data converting device may directly connected through a communication line to the embroidery machine. In this case, the converted sewing data stored in the RAM of the sewing data converting device is transmitted to the control device of the embroidery machine. The RAM serves as the storage means.

The functions of the sewing data converting device may be built in the sewing means (embroidery machine), or the sewing data converting device may comprise a general purpose personal computer. In each of these cases, the above-described program for the data conversion is preferably stored in a storage medium from which the computer can read, for example, a floppy disk or CD-ROM. The program stored in the storage medium is preferably installed in the personal computer or the sewing means so that the data conversion is executed on the personal computer or the sewing means. Additionally, the sewing means should not be limited to the household embroidery machines. The sewing means may be industrial embroidery machines or the like, instead.

The sewing data may be supplied to the embroidery machine by means of wireless communication or internet communication system.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim;:

1. A sewing data converting device comprising:

storage means for storing sewing data used in one sewing means for executing a sewing operation including an embroidering operation;

converting means for converting the sewing data into another sewing data used in another sewing means having a data format differing from one of said one sewing means; and display data originating means for originating display data for the converted sewing data so that the display data corresponds to a display format of said another sewing means.

2. A sewing data converting device of claim 1, further comprising data adding means for adding to the converted sewing data operating data for an operation of a needle thread peculiar to said another sewing means.

3. A sewing data converting device of claim 2, wherein the operation of the needle thread includes a needle rocking operation or a thread cutting operation.

4. A sewing data converting device of claim 1, further comprising data sequencing means for changing a sequence of a plurality of data including the converted sewing data and data related to the converted sewing data according to a data reading sequence in said another sewing means.

5. A sewing data converting device of claim 3, further comprising data sequencing means for changing a sequence of a plurality of data including the converted sewing data and data related to the converted sewing data according to a data reading sequence in said another sewing means.

6. A sewing data converting device of claim 1, wherein the storage means comprises a portable storage medium including an IC card and a floppy disk.

7. A sewing data converting device comprising:

storage means for storing sewing data used in one sewing means for executing a sewing operation including an embroidering operation;

converting means for converting the sewing data into another sewing data used in another sewing means having a data format differing from one of said one sewing means; and data adding means for adding to the converted sewing data operating data for an operation of a needle thread peculiar to said another sewing means.

8. A sewing data converting device of claim 7, wherein the operation of the needle thread includes a needle rocking operation or a thread cutting operation.

9. A sewing data converting device of claim 7, further comprising data sequencing means for changing a sequence of a plurality of data including the converted sewing data and data related to the converted sewing data according to a data reading sequence in said another sewing means.

10. A sewing data converting device of claim 8, further comprising data sequencing means for changing a sequence of a plurality of data including the converted sewing data and data related to the converted sewing data according to a data reading sequence in said another sewing means.

11. A sewing data converting device of claim 7, wherein the data adding means reads the converted sewing data for every one stitch and adds thread cutting data to an end of the read data when the read data is color change data, stop data or final data.

12. A sewing data converting device comprising:

storage means for storing sewing data used in one sewing means for executing a sewing operation including an embroidering operation;

converting means for converting the sewing data into another sewing data used in another sewing means having a data format differing from one of said one sewing means; and data sequencing means for changing a sequence of a plurality of data including the converted sewing data and data related to the converted sewing data according to a data reading sequence in said another sewing means.

13. A sewing data converting device of claim 12, wherein the data sequencing means arranges first address data indicative of first addresses of the plurality of data in a first set area and the plurality of data having data lengths differing from the data arranged in the first set area in a second set area continuously without margin or with a suitable margin.

14. A storage medium for storing a program for operating a sewing data converting device, the program accomplishing the functions of:

converting means for converting sewing data used in one sewing means into another sewing data used in another sewing means having a data format differing from one of said one sewing means; and display data originating means for originating display data for the converted sewing data so that the display data corresponds to a display format of said another sewing means.

15. A storage medium for storing a program for operating a sewing data converting device, the program accomplishing the functions of:

converting means for converting sewing data used in one sewing means into another sewing data used in another sewing means having a data format differing from one of said one sewing means; and data adding means for adding to the converted sewing data operating data for an operation of a needle thread peculiar to said another sewing means.

16. A storage medium for storing a program for operating a sewing data converting device, the program accomplishing the functions of:

converting means for converting sewing data used in one sewing means into another sewing data used in another sewing means having a data format differing from one of said one sewing means; and data sequencing means for changing a sequence of a plurality of data including the converted sewing data and data related to the converted sewing data according to a data reading sequence in said another sewing means.

* * * * *